US008313158B2

(12) United States Patent
Kubota et al.

(10) Patent No.: US 8,313,158 B2
(45) Date of Patent: Nov. 20, 2012

(54) PRINTING APPARATUS AND METHOD OF CONTROLLING PRINTING APPARATUS

(75) Inventors: Mai Kubota, Shiojiri (JP); Tomohiro Yuda, Minowa-machi (JP); Takahide Miyashita, Shiojiri (JP); Naoki Sudo, Matsumoto (JP); Akito Sato, Matsumoto (JP); Bunji Ishimoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 231 days.

(21) Appl. No.: 12/834,358

(22) Filed: Jul. 12, 2010

(65) Prior Publication Data

US 2011/0063347 A1 Mar. 17, 2011

(30) Foreign Application Priority Data

Sep. 15, 2009 (JP) ..... 2009-213015

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS

| | | | | |
|---|---|---|---|---|
| 6,336,705 | B1 | 1/2002 | Torigoe | |
| 6,547,352 | B1 * | 4/2003 | Ikeda | 347/11 |
| 2003/0081029 | A1 | 5/2003 | Underwood | |
| 2005/0200905 | A1 * | 9/2005 | Kimura | 358/3.27 |
| 2011/0057972 | A1 | 3/2011 | Kubota et al. | |

FOREIGN PATENT DOCUMENTS

| | | | |
|---|---|---|---|
| EP | 0925931 | B1 | 6/1999 |
| EP | 0935213 | A2 | 8/1999 |
| JP | 11-188896 | A | 7/1999 |
| JP | 2000-198227 | A | 7/2000 |
| JP | 2000-225719 | A | 8/2000 |
| JP | 2004-314534 | A | 11/2004 |
| JP | 2004-330624 | A | 11/2004 |
| JP | 2007-261205 | A | 10/2007 |

OTHER PUBLICATIONS

Office Action in U.S. Appl. No. 12/834,269 dated Apr. 30, 2012.
Extend European Search Report issued on Aug. 11, 2011 for Application No. 10187246.3.
Notice of Allowance in U.S. Appl. No. 12/834,269 dated Aug. 14, 2012 (5 pages).

* cited by examiner

*Primary Examiner* — Stephen Meier
*Assistant Examiner* — Tracey McMillion
(74) *Attorney, Agent, or Firm* — Nutter McClennen & Fish LLP; John J. Penny, Jr.; Christina M. Sperry

(57) ABSTRACT

A printing apparatus including: first nozzles which discharge a dye ink; second nozzles which discharge a pigment ink of the same color as the dye ink; and a controller which controls the discharge of the inks from the first nozzles and the second nozzles, wherein the controller executes a first discharging operation for discharging the dye ink from the first nozzles and then discharging the pigment ink from the second nozzles at predetermined positions on a medium and executes a second discharging operation for discharging the pigment ink from the second nozzles and then discharging the dye ink from the first nozzles at positions different from the predetermined positions on the medium, and wherein a ratio of the dye ink to the pigment ink in the amount of ink discharged in the second discharging operation per unit area is less than that in the first discharging operation per unit area.

7 Claims, 7 Drawing Sheets

| GRADATION VALUE | DOT SIZE | SELECTED PULSE |
|---|---|---|
| 00 | NO DOT | VP1 |
| 01 | SMALL DOT | PS2 |
| 10 | INTERMEDIATE DOT | PS1 |
| 11 | LARGE DOT | PS3 |

PRINTING APPARATUS AND METHOD OF CONTROLLING PRINTING APPARATUS

BACKGROUND

1. Technical Field

The present invention relates to a printing apparatus including nozzles for discharging a dye ink and nozzles for discharging a pigment ink with the same color as the dye ink and a method of controlling the printing apparatus.

2. Related Art

As a printing apparatus including nozzles for discharging a dye ink and nozzles for discharging a pigment ink with the same color as the dye ink, an ink jet recording apparatus including nozzles for discharging a black dye ink for printing a high-quality color image on exclusive paper and nozzle for discharging particularly black pigment ink for clearly printing characters or the like on plain paper is known (for example, see JP-A-2000-225719). Such an ink jet recording apparatus includes a head in which a nozzle array for discharging a dye ink and a nozzle array for discharging a pigment ink are arranged in a direction crossing a transport direction of a medium, and may perform printing using the dye ink and the pigment ink at a predetermined position of the medium while moving the head in the crossing direction.

However, the dye ink and the pigment ink used in the ink jet recording apparatus may be different in concentration when the inks are discharged on the medium, even in the same black. In addition, when the dye ink and the pigment ink are discharged while reciprocally moving the head in the direction crossing the transport direction of the medium so as to form an image, the order of inks discharged at a predetermined position of the medium is reversed in forward and backward paths of the head. That is, for example, the pigment ink is discharged on the dye ink discharged on the medium in the forward path and the dye ink is discharged on the pigment ink discharged on the medium in the backward direction. When the order of discharged inks is reversed, a portion printed in the forward path and a portion printed in the backward path are different in concentration and thus unevenness or a stripe pattern occurs in an image. Therefore, image quality deteriorates.

SUMMARY

An advantage of some aspects of the invention is that it provides a printing apparatus capable of printing a higher-quality image using a dye ink and a pigment ink, and a method of controlling the printing apparatus.

According to an aspect of the invention, there is provided a printing apparatus including: first nozzles which discharge a dye ink; second nozzles which discharge a pigment ink of the same color as the dye ink; and a controller which controls the discharge of the inks from the first nozzles and the second nozzles, wherein the controller executes a first discharging operation for discharging the dye ink from the first nozzles and then discharging the pigment ink from the second nozzles at predetermined positions on a medium and executes a second discharging operation for discharging the pigment ink from the second nozzles and then discharging the dye ink from the first nozzles at positions different from the predetermined positions on the medium, and wherein a ratio of the dye ink to the pigment ink in the amount of ink discharged in the second discharging operation per unit area is less than a ratio of the dye ink to the pigment ink in the amount of ink discharged in the first discharging operation per unit area.

BRIEF DESCRIPTION OF THE DRAWINGS

The invention will be described with reference to the accompanying drawings, wherein like numbers reference like elements.

DESCRIPTION OF EXEMPLARY EMBODIMENTS

Summary

Figure 1:
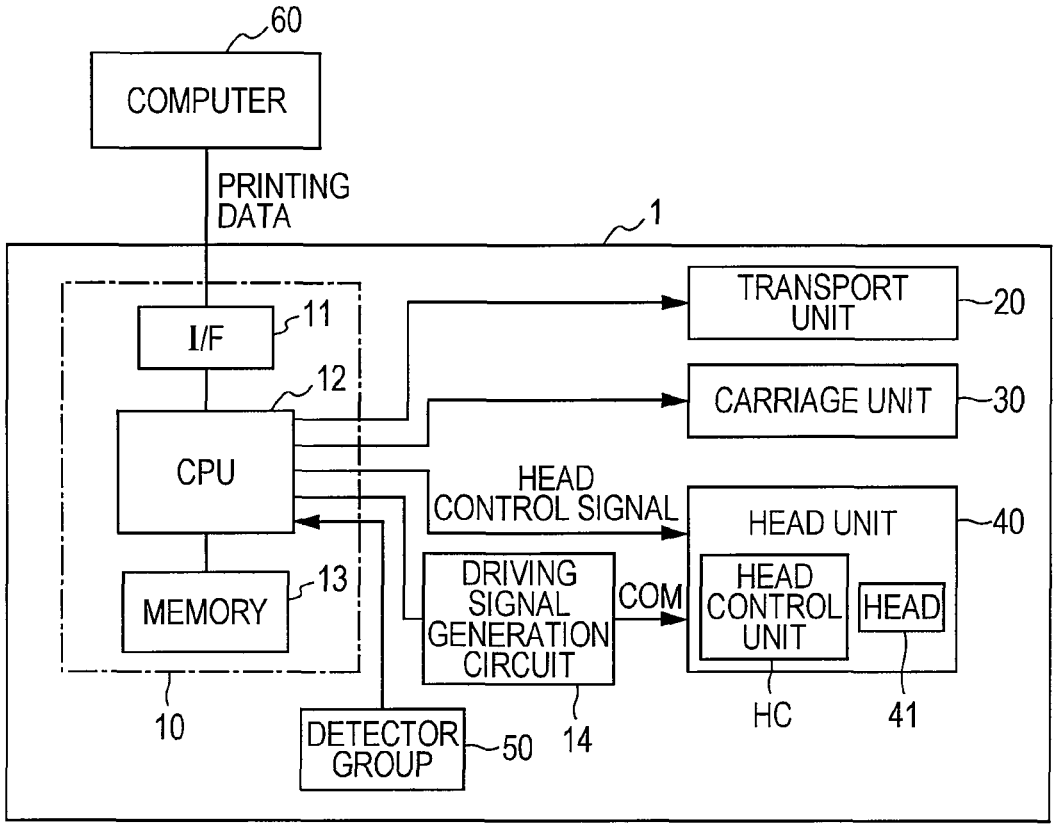
FIG. 1 is a block diagram showing the overall configuration of a printer according to the present embodiment.

At least the following will become apparent from the following specification and the accompanying drawings.

A printing apparatus includes first nozzles which discharge a dye ink, second nozzles which discharge a pigment ink of the same color as the dye ink, and a controller which controls the discharge of the inks from the first nozzles and the second nozzles, the controller executes a first discharging operation for discharging the dye ink from the first nozzles and then discharging the pigment ink from the second nozzles at predetermined positions on a medium and executes a second discharging operation for discharging the pigment ink from the second nozzles and then discharging the dye ink from the first nozzles at positions different from the predetermined positions on the medium, and a ratio of the dye ink to the pigment ink in the amount of ink discharged in the second discharging operation per unit area is less than a ratio of the dye ink to the pigment ink in the amount of ink discharged in the first discharging operation per unit area.

The concentrations of the pigment ink and the dye ink are different, even in the same color, because the order of the inks discharged on the medium is different when the inks are superimposed. For example, if the pigment ink is discharged after the dye ink is discharged, the concentration is low, as compared with the case where the dye ink is discharged after the pigment ink is discharged. Therefore, in the printing apparatus, the pigment ink and the dye ink are discharged such that the ratio of the dye ink to the pigment ink in the amount of ink discharged in the second discharging operation per unit area is less than a ratio of the dye ink to the pigment ink in the amount of ink discharged in the first discharging operation per unit area. Thus, the concentration of the region printed in the first discharging operation is increased. Accordingly, since a concentration difference between regions printed in the first discharging operation and the second discharging operation is small, it is possible to print a higher-quality image.

In the printing apparatus, the ratio of the dye ink to the pigment ink in the amount of ink discharged in the second discharging operation per unit area may be set to be less than the ratio of the dye ink to the pigment ink in the amount of ink discharged in the first discharging operation per unit area, by decreasing the amount of dye ink discharged in the second discharging operation.

A method of setting the ratio of the dye ink to the pigment ink discharged in the second discharging operation in the amount of ink per unit area to be less than the ratio of the dye ink to the pigment ink discharged in the first discharging operation in the amount of ink per unit area includes a method of increasing the amount of dye ink discharged in the first discharging operation and a method of decreasing the amount of dye ink discharged in the second discharging operation. At this time, in the printing apparatus, in the method of decreasing the amount of dye ink discharged in the second discharging operation, if the ratio of the dye ink to the pigment ink in the amount of ink discharged in the second discharging operation per unit area is set to be less than the ratio of the dye ink to the pigment ink in the amount of ink discharged in the first discharging operation per unit area, it is possible to set the ratio of the dye ink to the pigment ink in the amount of ink discharged in the second discharging operation per unit area to be less than the ratio of the dye ink to the pigment ink in the amount of ink discharged in the first discharging operation per unit area without increasing the number of times of discharging the ink and decreasing the transport amount of the medium. Therefore, since the number of times of discharging the ink is not increased or the transport amount of the medium is not decreased, it is possible to print a high-quality image without decreasing a printing speed.

In the printing apparatus, the dye ink and the pigment ink may be black.

The dye ink has high transparency and high color reproducibility and the pigment ink enables characters or the like to be clearly printed. Therefore, by including the black dye ink and pigment ink most frequently used to print characters so as to set the ratio of the dye ink to the pigment ink in the amount of ink discharged in the second discharging operation per unit area to be less than the ratio of the dye ink to the pigment ink in the amount of ink discharged in the first discharging operation per unit area, it is possible to suppress a concentration difference in printing using the dye ink and the pigment ink and to print a high-quality image, while clearly printing characters using the pigment ink.

The printing apparatus may further include a transport mechanism which transports the medium in a transport direction, a head in which the first nozzles and the second nozzles are arranged side by side in a direction crossing the transport direction, and a head movement mechanism which moves the head in both directions along the crossing direction, and the first discharging operation may be executed in movement of the head in one direction of the both directions and the second discharging operation may be executed in movement of the head in the other direction of the both directions.

In such a printing apparatus, when the head in which the first nozzles for discharging the dye ink and the second nozzles for discharging the pigment ink are arranged side by side in the direction crossing the transport direction of the medium discharges the inks while moving in both directions along the crossing direction, the order of inks discharged upon movement in one direction of both directions and the order of inks discharged upon movement in the other direction are different. Therefore, by executing the first discharging operation upon movement in one direction and the second discharging operation in the other direction, it is possible to suppress a concentration difference and to print a high-quality image while bi-directionally moving the head. Thus, it is possible to print a higher-quality image at a higher speed.

In the printing apparatus, the head may include a first nozzle array including the plurality of first nozzles arranged with a predetermined pitch along the transport direction and a second nozzle array including the plurality of second nozzles arranged with the predetermined pitch along the transport direction, and the nozzles of the first nozzle array may be arranged at positions shifted from the nozzles of the second nozzle array by a half of the predetermined pitch in the transport direction.

In such a printing apparatus, since the nozzles of the first nozzle array and the nozzles of the second nozzle array, both of which discharge the same-color inks, are arranged at positions shifted by a half of the pitch of each nozzle array in the transport direction, the dots formed by the second nozzles can be arranged between the dots formed by the first nozzles or the dots formed by the first nozzles can be arranged between the dots formed by the second nozzles in the transport direction. Therefore, it is possible to print a higher-quality image in a short period of time, as compared with a printing apparatus including only the first nozzle array or the second nozzle array.

A method of controlling a printing apparatus including first nozzles which discharge a dye ink, second nozzles which discharge a pigment ink of the same color as the dye ink, and a controller which controls the discharge of the inks from the first nozzles and the second nozzles includes executing a first discharging operation for discharging the dye ink from the first nozzles and then discharging the pigment ink from the second nozzles at predetermined positions on a medium, and executing a second discharging operation for discharging the pigment ink from the second nozzles and then discharging the dye ink from the first nozzles at positions different from the predetermined positions on the medium, such that a ratio of the dye ink to the pigment ink in the amount of ink discharged in the second discharging operation per unit area is less than a ratio of the dye ink to the pigment ink in the amount of ink discharged in the first discharging operation per unit area.

The pigment ink and the dye ink are different in concentration, even in the same color, because the orders of inks discharged on the medium are different when the inks are superimposed. For example, if the pigment ink is discharged after the dye ink is discharged, the concentration seems to be low, as compared with the case where the dye ink is discharged after the pigment ink is discharged. Therefore, the printing apparatus controls the dye ink to be discharged from the first nozzles controlled after the pigment ink is discharged from the second nozzles, such that the ratio of the dye ink to the pigment ink in the amount of ink discharged in the second discharging operation per unit area is less than a ratio of the dye ink to the pigment ink in the amount of ink discharged in the first discharging operation per unit area. Accordingly, since the concentration of the region printed in the first discharging operation is increased and a concentration difference between regions printed in the first discharging operation and the second discharging operation is reduced, it is possible to print a higher-quality image.

Hereinafter, best modes of the invention will be described with reference to the accompanying drawings. Although the following embodiments are variously restricted as the most suitable examples of the invention, the range of the invention is not limited thereto unless the following description restricts the invention. Hereinafter, for example, an ink jet printer (hereinafter, referred to as a printer) will be described as a printing apparatus of the invention.

Configuration of Printer

Figure 2:
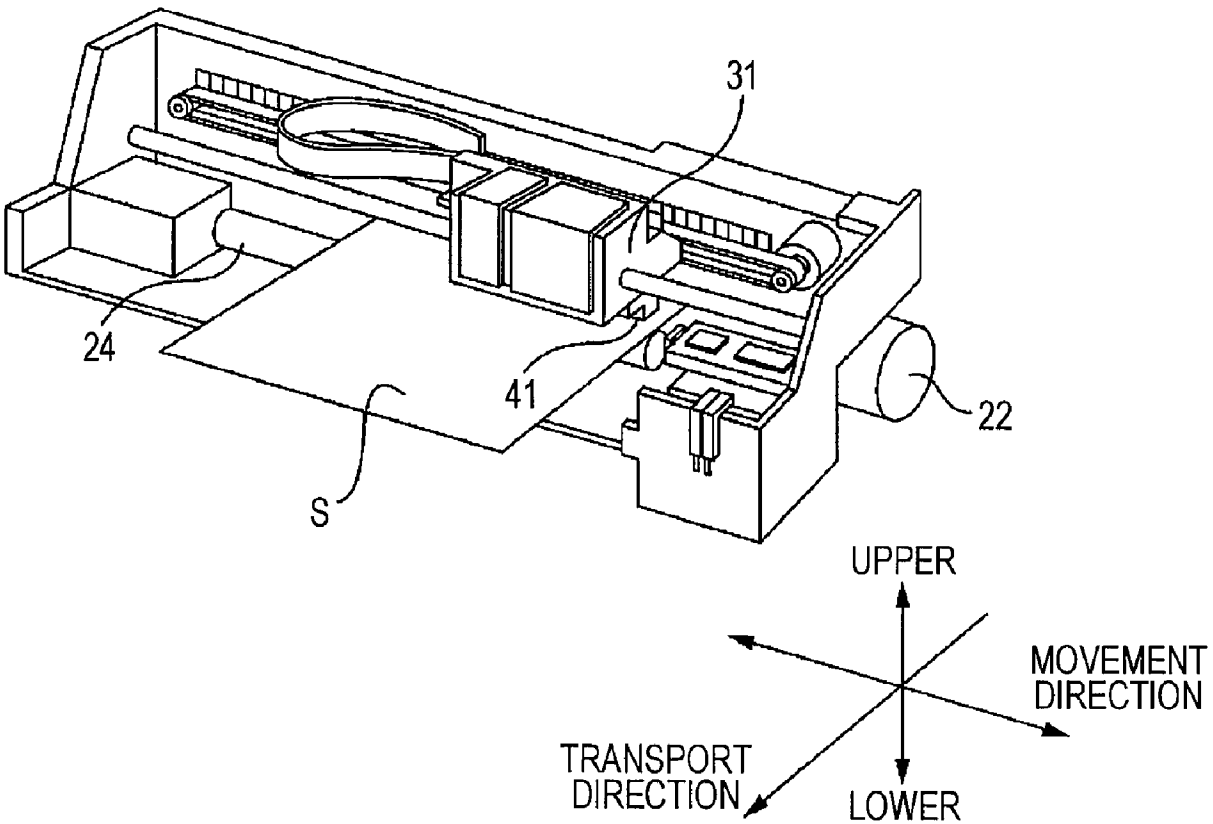
FIG. 2 is a perspective view of the printer.
Figure 3:
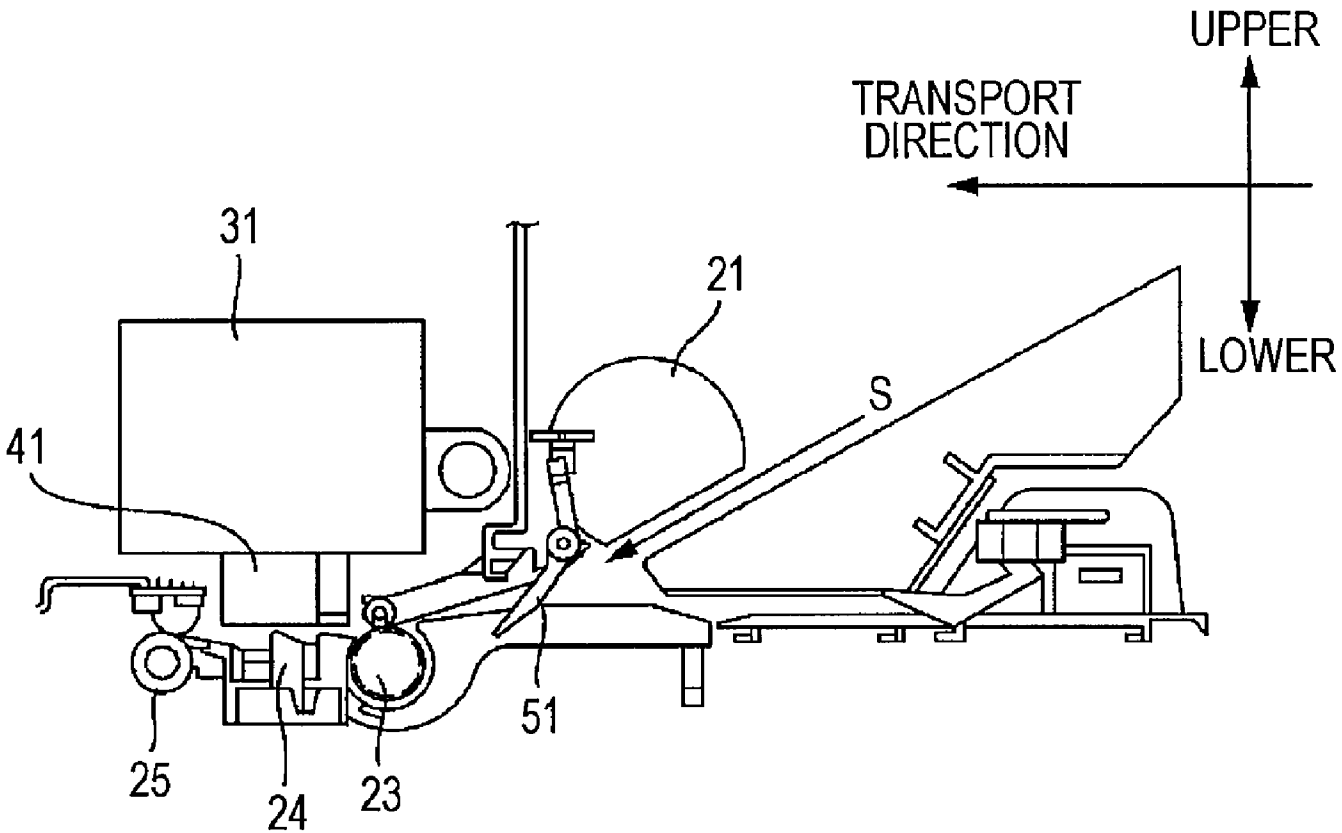
FIG. 3 is a cross-sectional view of the printer.

FIG. 1 is a block diagram showing the overall configuration of a printer 1 according to the present embodiment, FIG. 2 is a perspective view of the printer 1, and FIG. 3 is a cross-sectional view of the printer 1. The printer 1 which receives printing data from a computer 60 which is an external device controls units (a transport unit 20, a carriage unit 30, and a head unit 40) by a controller 10 so as to form an image on a sheet of paper S (medium). In addition, a detector group 50 monitors the situation in the printer 1 and the controller 10 controls the units based on the detected result.

The controller 10 is a control unit for controlling the printer 1. An interface unit 11 transmits or receives data between the computer 60 which is the external device and the printer 1. A memory 13 secures an area for storing a program of a CPU 12 or an operation area, or the like. The CPU 12 controls a control object portion according to a computer program (firmware or the like) stored in the memory 13. For example, the CPU 12 controls the transport unit 20 or the carriage unit 30. In addition, the CPU 12 transmits a head control signal for controlling an operation of a head 41 to a head control unit HC or transmits a control signal for generating a driving signal COM to a driving signal generation circuit 14.

The transport unit 20 transports the sheet S by a predetermined transport amount in a transport direction upon printing after moving the sheet S to a printable position, and includes a feed roller 21, a transport motor 22, a transport roller 23, a platen 24, and an ejection roller 25. By rotating the feed roller 21, the sheet S to be printed is fed to the transport roller 23. When a paper detection sensor 51 detects the position of a front end of the sheet S fed from the feed roller 21, the controller 10 rotates the transport roller 23 so as to position the sheet S at a printing start position. When the sheet S is positioned at the printing start position, at least some nozzles of the head 41 face the sheet S. The transport unit 20 corresponds to a transport mechanism.

The carriage unit 30 moves the head 41 in a direction (hereinafter, referred to as a movement direction) crossing the transport direction. The printer 1 can discharge the ink from the nozzles at the time of bi-directional movement of the movement direction. The carriage unit 30 corresponds to a head movement mechanism.

The head unit 40 includes the head 41 for discharging the ink on the sheet S. A plurality of nozzles functioning as ink discharging portions is provided in a lower surface of the head 41, and an ink chamber (not shown), in which the ink is contained, and a driving device (piezoelectric element) for changing capacity of the ink chamber so as to discharge the ink are provided in each of the nozzles.

Figure 4:
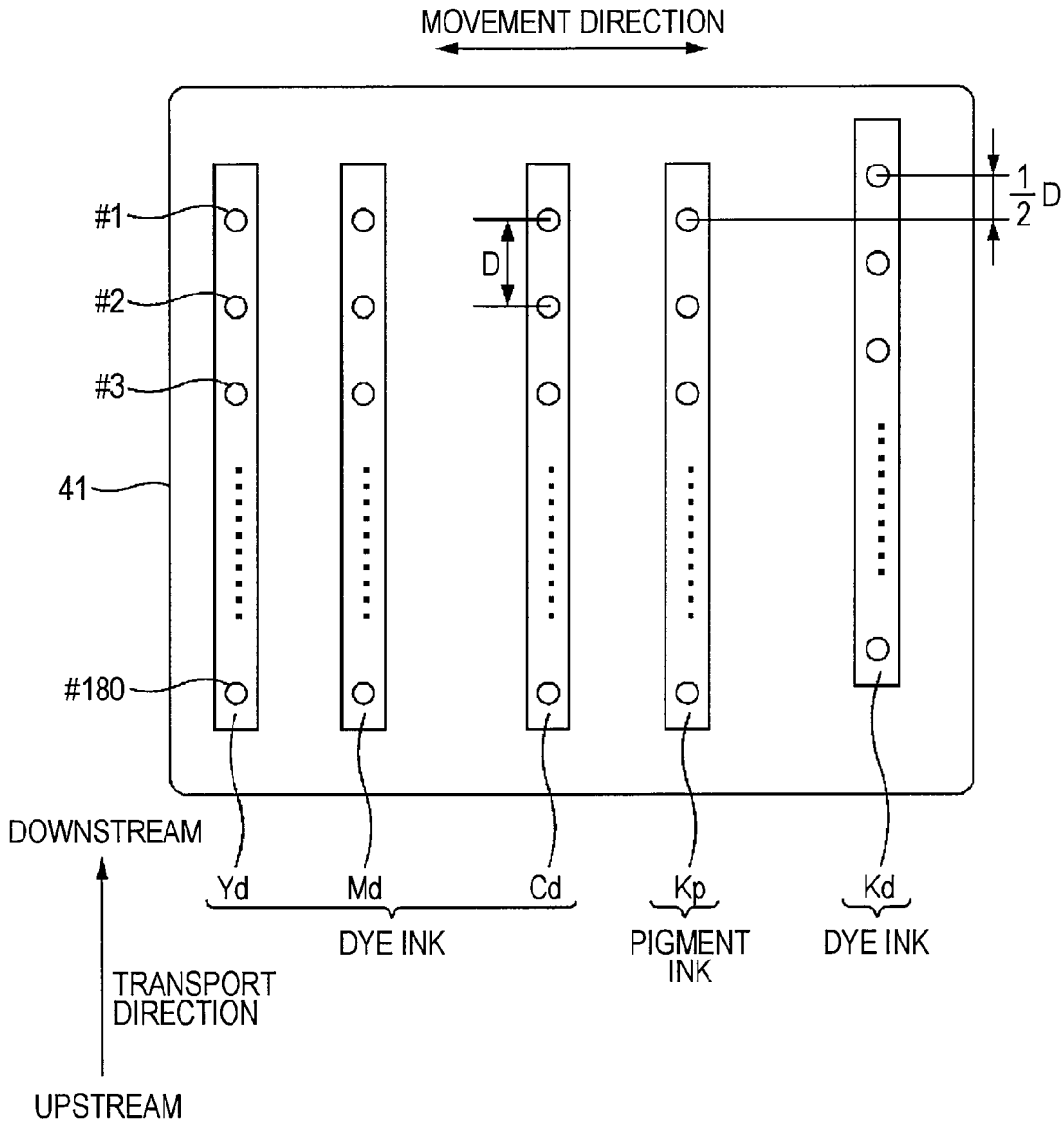
FIG. 4 is an explanation view showing the arrangement of nozzles in a lower surface of a head.

FIG. 4 is an explanation view showing the arrangement of nozzles in a lower surface (nozzle surface) of a head 41. From the nozzles of the head 41 of the printer 1 of the present embodiment, a black pigment ink, a black dye ink, and color (cyan, magenta and yellow) dye inks are respectively discharged. In a lower surface of the head 41, a black dye ink nozzle array Kd as a first nozzle array, a black pigment ink nozzle array Kp as a second nozzle array, a cyan dye ink nozzle array Cd, a magenta dye ink nozzle array Md, and a yellow dye nozzle array Yd are formed. Nozzles configuring the black dye ink nozzle array Kd correspond to first nozzles and nozzles configuring the black pigment ink nozzle array Kp correspond to second nozzles.

Each of the nozzle arrays includes 180 nozzles, wherein a nozzle located at a downstream side is denoted by a small number (#i=#1 to #180). In addition, the nozzles of each of the nozzle arrays are aligned at a constant distance (pitch) D (for example, 180 dpi) according to the transport direction (corresponding to a predetermined direction). In addition, in the nozzles of the four nozzle arrays including the black pigment nozzle array Kp, the cyan dye ink nozzle array Cd, the magenta dye ink nozzle array Md and the yellow dye ink nozzle array Yd provided in the lower surface of the head 41, the nozzles having the same number are arranged side by side in the movement direction, and the nozzles of the black dye ink nozzle array Kd are arranged on the downstream side from the nozzles of the other four nozzle arrays in the transport direction by a half of the nozzle pitch D.

In such a serial type printer 1, a dot forming process of intermittently discharging the inks from the head 41 moved in the movement direction so as to form dots on the sheet S and a transport process of transporting the sheet S in the transport direction are alternately repeated. Thus, dots are formed at positions different from predetermined positions of dots formed in a previous dot forming process, thereby forming an image.

The driving signal generation circuit 14 generates the driving signal COM based on DAC data. The DAC data is data for determining a variation pattern of the potential of the generated driving signal COM, is stored in the memory 13, is read upon the generation of the driving signal COM, and is output to the driving signal generation circuit 14. The head control unit HC selects a necessary portion of the driving signal COM generated by the driving signal generation circuit 14 based on a head control signal and applies the necessary portion to a piezoelectric element.

Figure 5:
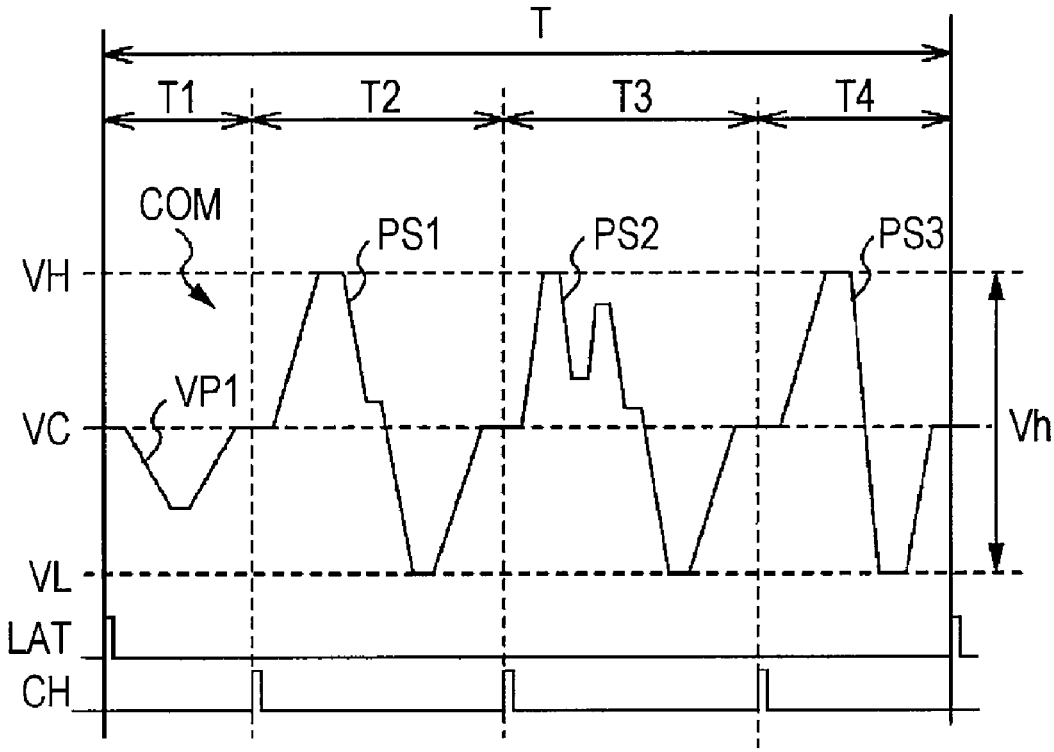
FIG. 5 is a diagram explaining a driving signal generated by a driving signal generation circuit.

The driving signal COM generated by the driving signal generation circuit 14 is, for example, shown in FIG. 5. In FIG. 5, a horizontal axis denotes a time and a vertical axis denotes the potential of the signal. The driving signal COM is repeatedly generated in every repetition period T. This repetition period T may be divided into four periods in correspondence with generated driving pulses. That is, a microvibration pulse VP is generated in a first period T1 and an intermediate dot pulse PS1 is generated in a second period T2. A small dot pulse PS2 is generated in a third period T3 and a large dot pulse PS3 is generated in a fourth period T4. Such periods are defined by a latch pulse of a latch signal LAT or a change pulse of a change signal CH.

The microvibration pulse VP is applied to the piezoelectric element when ink droplets are not discharged. When the microvibration pulse VP is applied, the piezoelectric element is slightly expanded or contracted such that a small pressure variation of the degree that the ink is not discharged is given the ink in a pressure chamber. By this pressure variation, the meniscus (the free surface of the ink exposed by the nozzles) microvibrates in the nozzles such that the thickening of the ink in the vicinity of the nozzles is suppressed. The intermediate dot pulse PS1 is applied to the piezoelectric element when an intermediate dot is formed on the sheet. Similarly, the small dot pulse PS2 is applied to the piezoelectric element when a small dot is formed and the large dot pulse PS3 is applied to the piezoelectric element when a large dot is formed.

Figures 6, 7:
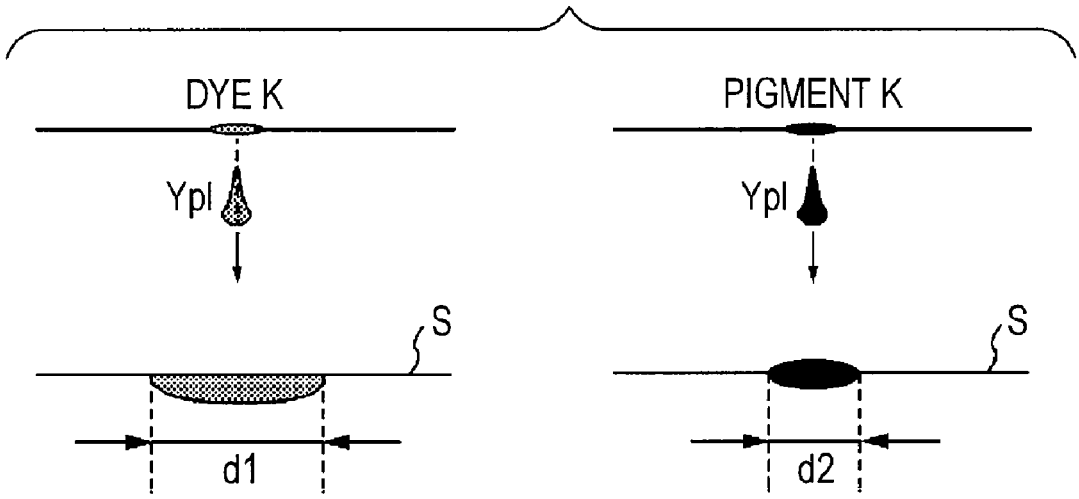
FIG. 6 is an image diagram showing a data table in which a correspondence data table between dot gradation values is included in printing data and driving pulses.
FIG. 7 is a diagram showing a difference between a dot diameter of a dye and a dot diameter of a pigment.

As shown in FIG. 6, in this printer 1, a driving pulse (microvibration pulse VP to large dot pulse PS3) is selected according to a dot gradation value included in printing data and is applied to the piezoelectric element. That is, the microvibration pulse VP is applied to the piezoelectric element according to a dot gradation value "00" indicating dot absence and the small dot pulse PS2 is applied to the piezoelectric element according to a dot gradation value "01" indicating the formation of a small dot. The intermediate dot pulse PS1 is applied to the piezoelectric element 431 according to a dot gradation value "10" indicating the formation of an intermediate dot and the large dot pulse PS3 is applied to the piezoelectric element according to a dot gradation value "11" indicating the formation of a large dot.

The printer 1 of the present embodiment discharges a pigment ink and a dye ink with respect to black. The pigment ink is hard to permeate and has excellent water resistance and weather resistance, as compared with the dye ink. However, since a pigment component which is a coloring material remains on the sheet, irregularities are formed on the surface and gloss is hard to output. In contrast, since the dye ink permeates the sheet as compared with the pigment ink, luster is easily output, but is apt to permeate and has poor water resistance or weather resistance.

In addition, the black pigment ink (hereinafter, referred to as a pigment K) can deeply represent the concentration of black as compared with the black dye ink (hereinafter, referred to as a dye K). Therefore, for example, when a monochrome text document is printed using the "pigment K", the quality of black characters can be improved. In contrast, when a color photographic image is printed using the "dye YMCK", a lustrous image can be obtained.

FIG. 7 is a diagram showing a difference between a dot diameter of a dye K and a dot diameter of a pigment K. If the same amount of ink Ypl is discharged from the nozzles, as shown in FIG. 7, the dot diameter d1 of the dye K is larger than the dot diameter d2 of the pigment K. This is because the dye K spreads in the surface of the sheet S while permeating the sheet S.

However, in the printer 1, as described above, the nozzle array Kp of the pigment K in which the nozzles for discharging the pigment K are arranged along the transport direction and the nozzle array Kd of the dye K in which the nozzles for discharging the dye K are arranged along the transport direction are arranged at an interval in the movement direction of the carriage 31. If an image is printed using the pigment K and the dye K while moving the carriage 31 in both directions along the movement direction, the order of inks discharged upon the movement in one direction of both directions is opposite to the order of inks discharged upon the movement in the other direction.

In detail, in FIG. 4, upon a first discharging operation (hereinafter, referred to as a forward-path operation) for discharging the inks at predetermined positions on the sheet S while moving the carriage 31 with the nozzle array Kd of the dye K as the head, the dye K is first discharged and the pigment K is then discharged and, upon a second discharging operation (hereinafter, referred to as a backward-path operation) for discharging the inks at predetermined positions on the sheet S while moving the carriage 31 with the yellow ink nozzle array Yd as the head, the pigment K is first discharged and the dye K is then discharged.

A portion in which the dye K is first discharged and the pigment K is then discharged and a portion in which the pigment K is first discharged and the dye K is discharged are different in concentration, although the same black is printed. In detail, the concentration of the portion in which the dye K is first discharged and the pigment K is then discharged is low and the concentration of the portion in which the pigment K is first discharged and the dye K is then discharged is high. This is because, when the pigment K is first discharged on the sheet S, the pigment K stays at that position, whereas, when the dye K is first discharged, the pigment K permeates the sheet S together with the dye K or spreads together with the dye such that the concentration is decreased.

Therefore, in the printer 1, when printing is performed using the dye K and the pigment K while moving the carriage 31 in both directions along the movement direction, the pigment K and the dye K are discharged such that a ratio of the dye K to the pigment K discharged in the backward-path operation is less than a ratio of the dye K to the pigment K discharged in the forward-path operation.

An operation when printing is performed using the dye K and the pigment K while moving the carriage 31 in both directions along the movement direction will be described. Now, an example in which the printer 1 receives a print command signal for rapidly printing a whole black image, that is, a solid image, by forming a raster line (line formed of dots arranged in the movement direction) with a pitch corresponding to a half of the nozzle pitch D from the computer 60 together with image data will be described.

The printer 1 can print an image using only the pigment K or the dye K. However, if the image is printed using only the pigment K or the dye K, so-called pseudo band printing of performing printing by repeating the transport of the length of the nozzle array and the transport of a distance of a half of the nozzle pitch D in the transport direction is performed. In addition, when a solid image filled with whole black dots is printed, the inks to form all large dots are discharged.

However, in the printer 1, the nozzle array Kd of the dye K and the nozzle array Kp of the pigment K are arranged at positions shifted in the transport direction by a half of the nozzle pitch D. Therefore, by performing printing using the dye K and the pigment K, it is possible to perform printing such that the raster line is formed with the pitch of a half of the nozzle pitch in the so-called band printing of performing printing by repeating only the transport of the length of the nozzle array without the transport of the distance corresponding to a half of the nozzle pitch D.

Therefore, the print command signal and the image data transmitted from the computer 60 to the printer 1 are the print command signal for printing a black solid image in bi-directional printing using the dye K and the pigment K and the image data in a printer driver of the computer 60.

In addition, the controller 10 of the printer 1 transmits, to the driving signal generation circuit 14, a signal for generating the driving signal COM for discharging the inks to form all large dots in the dye K and the pigment K if the movement direction of the carriage 31 is a direction in which the carriage 31 moves with the nozzle array Kd of the dye K as the head in FIG. 4, and discharging the inks to form all the intermediate dots in the dye K and discharging the inks to form all the large dots in the pigment K if the movement direction of the carriage is a direction in which the carriage 31 moves with the yellow ink nozzle array Yd as the head in FIG. 4, based on the received print command signal and image data.

Figure 8:
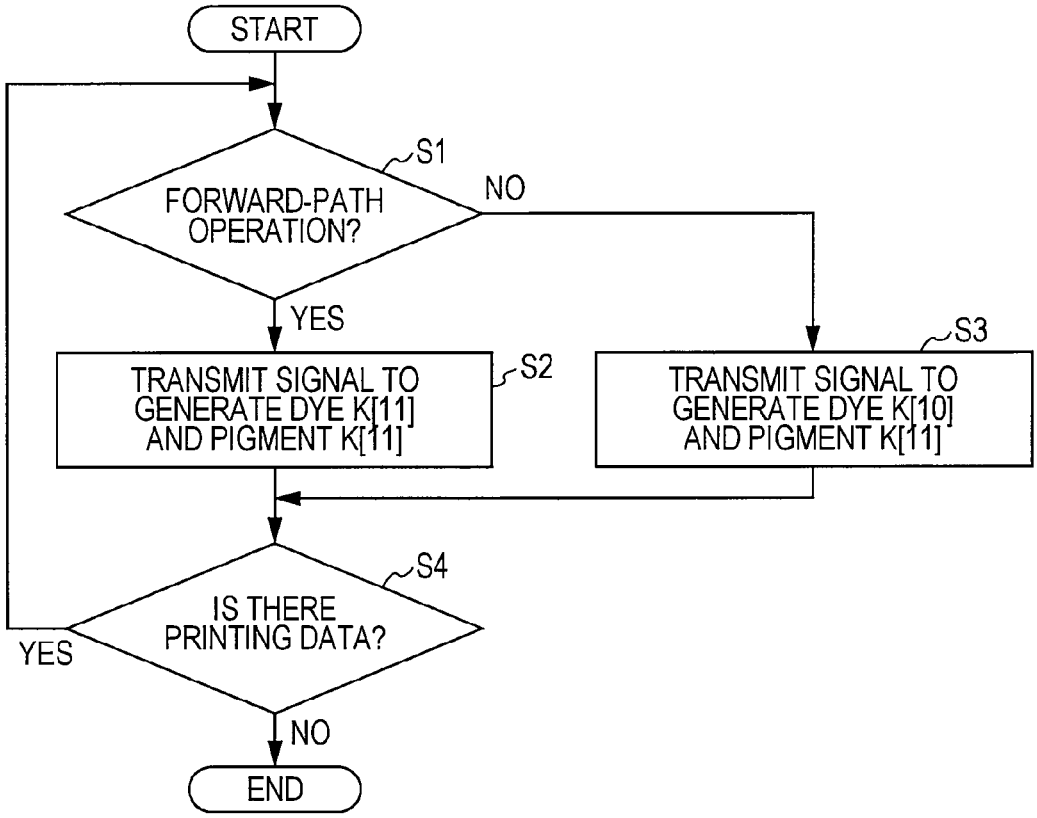
FIG. 8 is a diagram explaining control of a controller of a printer side.

That is, the controller 10 specifies the movement direction of the carriage 31 based on the received command signal, as shown in FIG. 8, when the print command signal for executing bi-directional printing using the dye K and the pigment K is received. At this time, if it is determined that the forward-path operation, that is, the printing operation for discharging the dye K at a predetermined position of the sheet S and then discharging the pigment K, is performed (S1), a signal is transmitted to the driving signal generation circuit 14 to generate the driving signal COM corresponding to the dot gradation value "11" indicating the formation of the large dots in the nozzle array Kd of the dye K and the nozzle array Kp of the pigment K (S2). In contrast, if it is determined that the backward-path operation, that is, the printing operation for discharging the pigment K at a predetermined position of the sheet S and then discharging the dye K, is performed (S1), a signal is transmitted to the driving signal generation circuit 14 to generate the driving signal COM corresponding to the dot gradation value "10" indicating the formation of the intermediate dot in the nozzle array Kd of the dye K and the driving signal COM corresponding to the dot gradation value "11" indicating the formation of the large dots in the nozzle array Kp of the pigment K (S3).

Based on the driving signal COM transmitted from the driving signal generation circuit 14, the large dot pulse PS3 or the intermediate dot pulse PS1 is applied to the piezoelectric element.

In the printer 1 of the present embodiment, when the head 41 in which the nozzles for discharging the dye K and the nozzles for discharging the pigment K are arranged side by side in the direction crossing the transport direction of the sheet S discharges the inks while moving in both directions along the crossing direction, the order of inks discharged upon movement in one direction of both directions and the order of inks discharged upon movement in the other direction are different. In addition, when the printer 1 discharges the same amount of pigment K after discharging the dye K, the concentration is decreased, as compared with the case where the same amount of dye K is discharged after discharging the pigment K. Therefore, the printer 1 discharges the pigment K and the dye K such that the ratio of the dye K to the pigment K discharged in the backward-path operation in the amount of ink per unit area is less than the ratio of the dye K to the pigment K discharged in the forward-path operation in the amount of ink per unit area. Accordingly, the concentration of the region printed in the forward-path operation is increased. Since a concentration difference between the regions printed in the forward-path operation and the backward-path operation is decreased, it is possible to print a higher-quality image. That is, by executing the forward-path operation upon movement of the head 41 in one direction and the backward-path operation upon movement in the other direction, it is possible to suppress a concentration difference and to print a high-quality image while bi-directionally moving the head 41. Therefore, it is possible to print a higher-quality image at a higher speed.

A method of setting the ratio of the dye K to the pigment K discharged in the backward-path operation in the amount of ink per unit area to be less than the ratio of the dye K to the pigment K discharged in the forward-path operation in the amount of ink per unit area includes a method of increasing the amount of dye K discharged in the forward-path operation and a method of decreasing the amount of dye K discharged in the backward-path operation. At this time, in the printer 1, in the method of decreasing the amount of dye K discharged in the backward-path operation, if the ratio of the dye K to the pigment K in the amount of ink discharged in the backward-path operation per unit area is set to be less than the ratio of the dye K to the pigment K in the amount of ink discharged in the forward-path operation per unit area, it is possible to set the ratio of the dye K to the pigment K in the amount of ink discharged in the backward-path operation per unit area to be less than the ratio of the dye K to the pigment K in the amount of ink discharged in the forward-path operation per unit area without increasing the number of times of discharging the ink and decreasing the transport amount of the sheet S. That is, since the number of times of discharging the ink is not increased or the transport amount of the sheet S is not decreased, it is possible to print a high-quality image without decreasing a printing speed.

The dye ink has high transparency and high color reproducibility and the pigment ink enables characters or the like to be clearly printed. Therefore, by including the black dye K and pigment K most frequently used to print characters so as to set the ratio of the dye K to the pigment K in the amount of ink discharged in the backward-path operation per unit area to be less than the ratio of the dye K to the pigment K in the amount of ink discharged in the forward-path operation per unit area, it is possible to suppress a concentration difference in printing using the dye K and the pigment K and to print a high-quality image, while clearly printing characters using the pigment K.

In addition, since the nozzles of the nozzle array Kd of the dye K and the nozzles of the nozzle array Kp of the pigment K, both of which discharge the black inks, are arranged at positions shifted by a half of the pitch D of each nozzle array in the transport direction, the dots formed by the nozzles of the pigment K can be arranged between the dots formed by the nozzles of the dye K or the dots formed by the nozzles of the dye K can be arranged between the dots formed by the nozzles of the pigment K in the transport direction. Therefore, it is possible to print a higher-quality image in a short period of time, as compared with a printer including only the nozzle array Kd of the dye K or the nozzle array Kp of the pigment K.

Although an example in which the ratio of the dye K to the pigment K in the discharge amount is changed by changing the sizes of the dots from the large dots to the intermediate dots is described in the above embodiment, the sizes of the dots formed by the ink discharged from the nozzles, the amount of ink discharged from which is reduced, may be the small dots. Although an example in which the ratio of the dye K to the pigment K in the discharge amount is changed by changing the sizes of the dots is described, the invention is not limited thereto. For example, the pulse applied to the piezoelectric element may be changed. That is, the pigment K and the dye K may be discharged such that the concentration difference between the region printed when the pigment K is first discharged and the dye K is then discharged and the region printed when the dye K is first discharged and the pigment K is then discharged is decreased and the ratio of the dye K to the pigment K discharged in the operation for discharging the pigment K and then discharging the dye K is less than the ratio of the dye K to the pigment K discharged in the operation for discharging the dye K and then discharging the pigment K.

The invention is not limited to the printer if a printing apparatus capable of performing printing using a dye ink and a pigment ink is used and is applicable to various ink jet recording apparatus such as a plotter, a facsimile machine or a copier.

The entire disclosure of Japanese Patent Application No. 2009-213015, filed Sep. 15, 2009 is expressly incorporated by reference herein.

What is claimed is:

1. A printing apparatus comprising:

first nozzles which discharge a dye ink;

second nozzles which discharge a pigment ink with the same color as the dye ink; and a controller which controls the discharge of the inks from the first nozzles and the second nozzles, wherein the controller executes a first discharging operation for discharging the dye ink from the first nozzles and then discharging the pigment ink from the second nozzles at predetermined positions on a medium and executes a second discharging operation for discharging the pigment ink from the second nozzles and then discharging the dye ink from the first nozzles at positions different from the predetermined positions on the medium, and wherein a ratio of the dye ink to the pigment ink in the amount of ink discharged in the second discharging operation per unit area is less than a ratio of the dye ink to the pigment ink in the amount of ink discharged in the first discharging operation per unit area.

2. The printing apparatus according to claim 1, wherein the ratio of the dye ink to the pigment ink in the amount of ink discharged in the second discharging operation per unit area is set to be less than the ratio of the dye ink to the pigment ink in the amount of ink discharged in the first discharging operation per unit area, by decreasing the amount of dye ink discharged in the second discharging operation.

3. The printing apparatus according to claim 1, wherein the dye ink and the pigment ink are black.

4. The printing apparatus according to claim 1, further comprising:

a transport mechanism which transports the medium in a transport direction;

a head in which the first nozzles and the second nozzles are arranged side by side in a direction crossing the transport direction; and a head movement mechanism which moves the head in both directions along the crossing direction, wherein the first discharging operation is executed in movement of the head in one direction of both directions and the second discharging operation is executed in movement of the head in the other direction of both directions.

5. The printing apparatus according to claim 1, wherein:

the head includes a first nozzle array including the plurality of first nozzles arranged with a predetermined pitch along the transport direction and a second nozzle array including the plurality of second nozzles arranged with the predetermined pitch along the transport direction, and the nozzles of the first nozzle array are arranged at positions shifted from the nozzles of the second nozzle array by a half of the predetermined pitch in the transport direction.

6. The printing apparatus according to claim 1, further comprising:

a transport mechanism which transports the medium in a transport direction;

a head in which the first nozzles and the second nozzles are arranged side by side in a direction crossing the transport direction; and a head movement mechanism which moves the head in both directions along the crossing direction, wherein the head includes a first nozzle array including the plurality of first nozzles arranged with a predetermined pitch along the transport direction and a second nozzle array including the plurality of second nozzles arranged with the predetermined pitch along the transport direction, wherein the nozzles of the first nozzle array are arranged at positions shifted from the nozzles of the second nozzle array by a half of the predetermined pitch in the transport direction, wherein the first discharging operation is executed in movement of the head in one direction of both directions and the second discharging operation is executed in movement of the head in the other direction of both directions, wherein the ratio of the dye ink to the pigment ink in the amount of ink discharged in the second discharging operation per unit area is set to be less than the ratio of the dye ink to the pigment ink in the amount of ink discharged in the first discharging operation per unit area, by decreasing the amount of dye ink discharged in the second discharging operation, and wherein the dye ink and the pigment ink are black.

7. A method of controlling a printing apparatus including first nozzles which discharge a dye ink, second nozzles which discharge a pigment ink of the same color as the dye ink, and a controller which controls the discharge of the inks from the first nozzles and the second nozzles, the method comprising:

executing a first discharging operation for discharging the dye ink from the first nozzles and then discharging the pigment ink from the second nozzles at predetermined positions on a medium, and executing a second discharging operation for discharging the pigment ink from the second nozzles and then discharging the dye ink from the first nozzles at positions different from the predetermined positions on the medium, such that a ratio of the dye ink to the pigment ink in the amount of ink discharged in the second discharging operation per unit area is less than a ratio of the dye ink to the pigment ink in the amount of ink discharged in the first discharging operation per unit area.

* * * * *